US010940367B2

(12) United States Patent
Chen

(10) Patent No.: US 10,940,367 B2
(45) Date of Patent: Mar. 9, 2021

(54) GOLF BALL

(71) Applicant: Uniqforce Digital Integration Co, Ltd., Taipei (TW)

(72) Inventor: Bo-Jun Chen, Taipei (TW)

(73) Assignee: Uniqforce Digital Integration Co, Ltd., Taipei (TW)

( * ) Notice: Subject to any disclaimer, the term of this patent is extended or adjusted under 35 U.S.C. 154(b) by 0 days.

(21) Appl. No.: 16/709,921

(22) Filed: Dec. 11, 2019

(65) Prior Publication Data

US 2020/0179765 A1 Jun. 11, 2020

(30) Foreign Application Priority Data

Dec. 11, 2018 (TW) ..... 107144650

(51) Int. Cl.
*A63B 37/00* (2006.01)
*A63B 43/00* (2006.01)

(52) U.S. Cl.
CPC ..... *A63B 37/0038* (2013.01); *A63B 37/0072* (2013.01); *A63B 43/00* (2013.01); *A63B 2225/50* (2013.01)

(58) Field of Classification Search
CPC . A63B 43/00; A63B 37/0038; A63B 37/0003; A63B 37/0023; A63B 37/005
USPC ..... 473/353
See application file for complete search history.

(56) References Cited

U.S. PATENT DOCUMENTS

2004/0142766 A1* 7/2004 Savarese ..... A63B 24/0021 473/353
2005/0070375 A1* 3/2005 Savarese ..... H01Q 1/22 473/351
2005/0070376 A1* 3/2005 Savarese ..... A63B 37/0003 473/353
2006/0122007 A1* 6/2006 Savarese ..... A63B 37/0003 473/351
2011/0215977 A1* 9/2011 Van Driel ..... A63B 37/0003 343/720
2012/0139729 A1* 6/2012 Savarese ..... G06K 7/10 340/568.6
2012/0142443 A1* 6/2012 Savarese ..... G08B 21/0266 473/199
2012/0255998 A1* 10/2012 Luciano, Jr. ..... A63B 43/00 235/439
2013/0196788 A1* 8/2013 Shimizu ..... A63B 37/0003 473/371
2015/0087443 A1* 3/2015 Kitazaki ..... A63B 43/004 473/373
2015/0379388 A1* 12/2015 Komatsu ..... A63B 37/0064 473/353

(Continued)

FOREIGN PATENT DOCUMENTS

CN 108348804 * 7/2018 ..... A63B 37/00
TW I442959 7/2014
TW I543800 8/2016

*Primary Examiner* — John E Simms, Jr.
(74) *Attorney, Agent, or Firm* — JCIPRNET

(57) ABSTRACT

A golf ball including at least a layer of ball shell, at least a layer of ball core, and an antenna layer is provided. The ball core is provided in the ball shell. The antenna layer is inserted between the ball shell and the ball core or provided on an outer side of the ball shell. A material of the antenna layer includes a conductive material having fluidity or ductility that auto-recovers the shape and does not break after a hit.

10 Claims, 2 Drawing Sheets

(56) References Cited

U.S. PATENT DOCUMENTS

2017/0001080 A1* 1/2017 Komatsu ..... A63B 37/0074

* cited by examiner

GOLF BALL

CROSS-REFERENCE TO RELATED APPLICATION

This application claims the priority benefit of Taiwan application serial no. 107144650, filed on Dec. 11, 2018. The entirety of the above-mentioned patent application is hereby incorporated by reference herein and made a part of this specification.

BACKGROUND

Technical Field

The disclosure relates to a sporting goods, in particular to a golf ball.

Description of Related Art

Along with the swift technological advancement, the material culture and the quality of life also continue to arise while leisure time exercise becomes a trend. Golf sport, once taken as a sport form exclusive to the nobles, is now popularized by the trend of leisure time exercise. The participants of golf sport can be seen at all ages, and the enthusiasts include all genders. Furthermore, the people who participate in golf sport have been rapidly increasing in recent years.

During a golf competition, it is required to have an accurate judgment of the location of a hit golf ball to avoid a waste of time looking for the golf ball. It is in light of this that some golf balls are designed to have a built-in chip or an antenna to transmit signals to an external device via active or passive means to fulfill the purpose of detecting the location of the golf ball. However, the chip and the antenna built in a golf ball are prone to be damaged by the impact force of the hit, and also the center of gravity of a golf ball can be altered by the configuration of the chip and the antenna and thus deviates from the mass center, causing an unpredictable flight path.

SUMMARY

The disclosure provides a golf ball which provides a location detection function and has great reliability.

A golf ball of the disclosure includes at least a layer of ball shell, at least a layer of ball core, and an antenna layer. The ball core is provided in the ball shell. The antenna layer is provided between the ball shell and the ball core or on an outer side of the ball shell. A material of the antenna layer includes a conductive material having fluidity or ductility which auto-recovers and does not break after a hit.

In an embodiment of the disclosure, the antenna layer is provided on a surface of the ball shell or a surface of the ball core.

In an embodiment of the disclosure, the antenna layer is provided symmetrically to a ball center of the golf ball.

In an embodiment of the disclosure, the golf ball includes at least two chips, which are provided between the ball shell and the ball core or on the outer side of the ball shell and are electrically connected to the antenna layer.

In an embodiment of the disclosure, the at least two chips are provided symmetrically to a ball center of the golf ball.

In an embodiment of the disclosure, the at least two chips are provided on a surface of the ball shell or a surface of the ball core.

In an embodiment of the disclosure, the at least a layer of ball shell includes a plurality of layers, and the two chips are provided between adjacent two layers of the ball shell.

In an embodiment of the disclosure, the at least a layer of ball core includes a plurality of layers, and the two chips are provided between adjacent two layers of the ball core.

In an embodiment of the disclosure, the at least a layer of ball shell includes a plurality of layers, and the antenna layer is provided between adjacent two layers of the ball shell.

In an embodiment of the disclosure, the at least a layer of ball core includes a plurality of layers, and the antenna layer is provided between adjacent two layers of the ball core.

In an embodiment of the disclosure, the material of the antenna layer includes a liquid metal.

In an embodiment of the disclosure, the material of the antenna layer includes metal powder.

In an embodiment of the disclosure, the material of the antenna layer includes an electrically conductive adhesive having ductility.

Based on the above, in the golf ball of the disclosure, the antenna layer is made of a conductive material having fluidity or ductility, which produces a buffering effect when the golf ball takes an impact force of a hit, and maintains or restores structural integrity.

In order to make the aforementioned and other features and advantages of the disclosure more comprehensible, several exemplary embodiments accompanied with figures are described in detail below.

DESCRIPTION OF THE EMBODIMENTS

Figure 1:
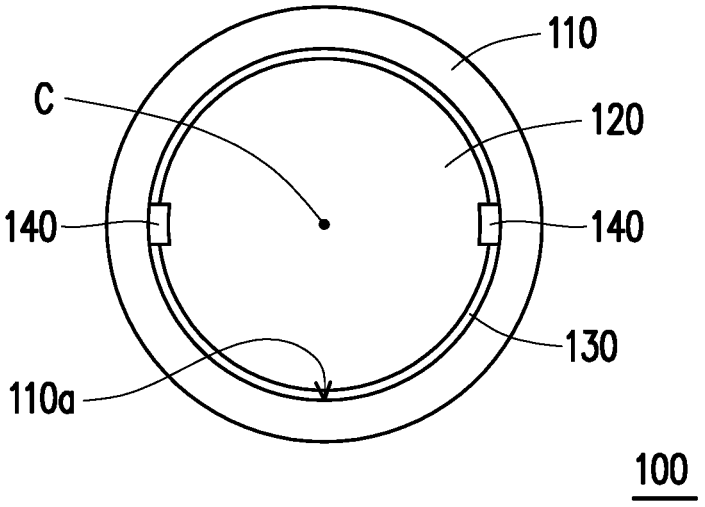
FIG. 1 is a cross-sectional view of a golf ball according to an embodiment of the disclosure.

FIG. 1 is a cross-sectional view of a golf ball according to an embodiment of the disclosure. Referring to FIG. 1, according to the present embodiment, a golf ball 100 includes at least a layer of ball shell 110 (one layer is illustrated), at least a layer of ball core 120 (one layer is illustrated), and an antenna layer 130. The ball core 120 is provided in the ball shell 110, and the antenna layer 130 is provided between the ball shell 110 and the ball core 120.

According to the present embodiment, a material of the antenna layer 130 includes a conductive material having fluidity or ductility, which provides a buffering or an auto-recovery effect when the golf ball takes an impact force of a hit, and maintains or restores the structural integrity after the golf ball is deformed by the impact. Such design avoids the conductivity and antenna features of the antenna layer 130 and the function of the antenna from being affected by structural deformation or fracture caused by the impact force, thereby increasing the durability and reliability of the golf ball 100.

A conductive material having fluidity may be liquid metal, metal powder, electrically conductive adhesive, etc., instead of a general solid conductive material. To be more specific, a conductive material having fluidity may be selenium-graphite powder, silver paste, or special electrically conductive adhesive, but the disclosure is not limited thereto.

To put it in detail, the antenna layer 130 of the present embodiment is disposed on an inner surface 110*a* of the ball shell 110 by printing, spraying, or coating, and then covers the outside of the ball core 120 together with the ball shell 110. Furthermore, the antenna layer 130 is provided symmetrically to a ball center C of the golf ball 100 to avoid a change in a center of gravity of the golf ball 100 into a location not as expected due to the addition of the antenna layer 130.

Also, when the golf ball 100 takes a hit, the ball center C of the golf ball 100 generally takes a greater impact. In light of this, instead of being provided at or near the ball center C of the golf ball 100, the antenna layer 130 is provided between the ball shell 110 and the ball core 120 as stated above to avoid the antenna layer 130 from taking excessive impact and being damaged.

Figure 2:
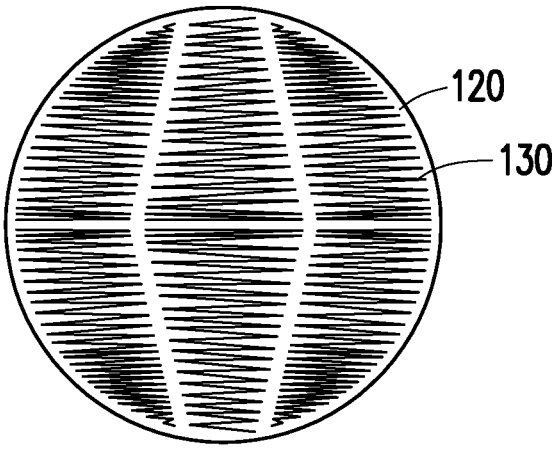
FIG. 2 is a side view of a partial structure of the golf ball in FIG. 1.

FIG. 2 is a side view of a partial structure of the golf ball in FIG. 1. To make the figure more comprehensible, FIG. 2 only illustrates the ball core 120 and the antenna layer 130 of FIG. 1. The antenna layer 130 shown in FIG. 1 is merely for the purpose of demonstration. The structure of the antenna layer 130 in actual practice may be extended in a winding manner as shown in FIG. 2 and be distributed symmetrically on the inner surface 110*a* of the ball shell 110 (illustrated in FIG. 1). In other embodiments, the antenna layer 130 may also be extended in other manners as the disclosure does not put a restriction in this respect.

Referring to FIG. 1, the golf ball 100 of the present embodiment further includes at least two chips 140, and the two chips 140 are provided on the inner surface 110*a* of the ball shell 110, located between the ball shell 110 and the ball core 120, and electrically connected to the antenna layer 130. The antenna layer 130 and the chips 140, for example, form a passive signal reflecting module to reflect a detecting signal from an external detecting device back to the external detecting device to inform a user the location of the golf ball 100 via the external detecting device.

In the present embodiment, the two chips 140 are provided symmetrically to the ball center C of the golf ball 100 to avoid a change in the center of gravity of the golf ball 100 into a location not as expected due to the addition of the chips 140. In other embodiments, more chips 140 may be disposed and the chips 140 are also provided symmetrically to the ball center C of the golf ball 100. The disclosure puts no restriction on the number of the chips.

Also, when the golf ball 100 takes a hit, the ball center C of the golf ball 100 generally takes a greater impact. In light of this, instead of being provided at or near the ball center C of the golf ball 100, the chips 140 are provided between the ball shell 110 and the ball core 120 as stated above to avoid the chips 140 from taking excessive impact and being damaged while also protecting integrity of the ball core.

Figure 3:
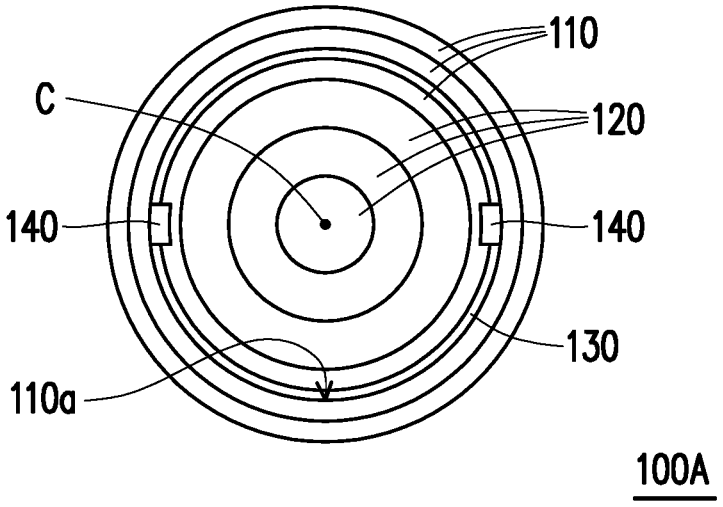
FIG. 3 is a cross-sectional view of a golf ball according to another embodiment of the disclosure.

FIG. 3 is a cross-sectional view of a golf ball according to another embodiment of the disclosure. The differences between a golf ball 100A shown in FIG. 3 and the golf ball 100 shown in FIG. 1 are that the ball shell 110 of the golf ball 100A has multiple layers (three layers are illustrated), that the ball core 120 has multiple layers (three layers are illustrated), and that the antenna layer 130 and the chips 140 are provided on the inner surface 110*a* of one of the layers of the ball shell 110 and located between adjacent two layers of the ball shell 110. In the golf ball 100A, the antenna layer 130 and the chips 140 may also be provided between the innermost layer of the ball shell 110 and the outermost layer of the ball core 120 adjacent to each other. Nevertheless, the disclosure does not put a restriction in this respect.

Figure 4:
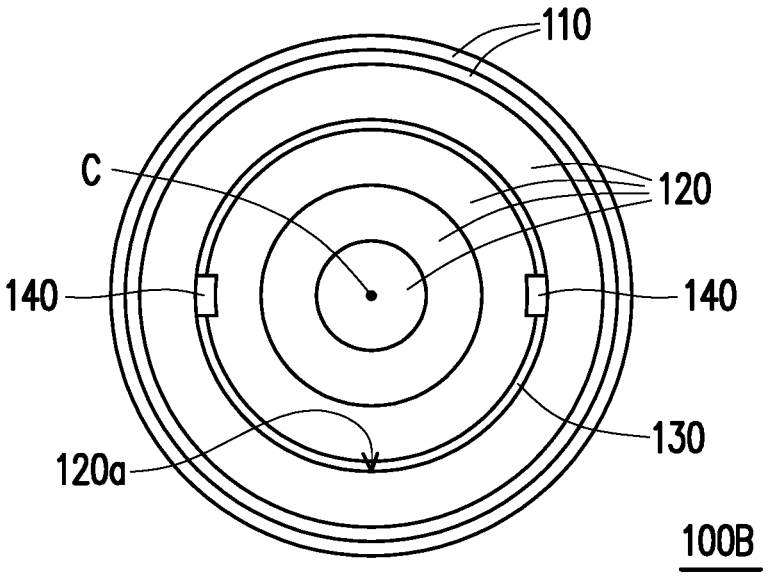
FIG. 4 is a cross-sectional view of a golf ball according to another embodiment of the disclosure.

FIG. 4 is a cross-sectional view of a golf ball according to another embodiment of the disclosure. The differences between a golf ball 100B shown in FIG. 4 and the golf ball 100 shown in FIG. 1 are that the ball shell 110 of the golf ball 100B has multiple layers (two layers are illustrated), that the ball core 120 has multiple layers (four layers are illustrated), and that the antenna layer 130 and the chips 140 are provided on an inner surface 120*a* of one of the layers of the ball core 120 and located between adjacent two layers of the ball core 120. In the golf ball 100B, the antenna layer 130 and the chips 140 may also be provided between the innermost layer of the ball shell 110 and the outermost layer of the ball core 120 adjacent to each other. The disclosure does not put a restriction in this respect.

Similar to the configuration of FIG. 1, the antenna layer 130 and the chips 140 are not provided at or near the ball center C of the golf ball 100A or the golf ball 100B in the configurations of FIG. 3 and FIG. 4, and the configurations also avoid the antenna layer 130 and the chips 140 from taking excessive impact and being damaged.

The disclosure does not put restriction on a material of the ball shell 110. In any of the aforementioned embodiments, the outermost layer of the ball shell 110 may be a paint layer. In addition, the antenna layer 130 and the chips 140 may be disposed on the outer side of the outermost ball shell to be located at the outer surface of the golf ball.

To sum up the above, in the golf ball of the disclosure, the antenna layer is made of a conductive material having fluidity or ductility which provides a buffering or an auto-recovery effect when the golf ball takes an impact force of a hit, and maintains or restores the structural integrity after the golf ball is deformed by the impact. Also, the antenna layer and the chip are provided symmetrically to the ball center of the golf ball to avoid a change in the center of gravity of the golf ball into a location not as expected due to the addition of the antenna layer and the chip. In addition, instead of being provided at or near the ball center of the golf ball, the antenna layer and the chip are provided between the ball shell and the ball core, thereby avoiding the antenna layer and the chip from taking excessive impact and being damaged while also protecting integrity of the ball core.

It will be apparent to those skilled in the art that various modifications and variations can be made to the structure of the disclosure without departing from the scope or spirit of the disclosure. In view of the foregoing, it is intended that the disclosure covers modifications and variations of this disclosure provided they fall within the scope of the following claims and their equivalents.

What is claimed is:

1. A golf ball, comprising:

at least a layer of ball shell;

at least a layer of ball core, provided in the at least a layer of ball shell; and an antenna layer, provided between the at least a layer of ball shell and the at least a layer of ball core or on an outer side of the at least a layer of ball shell, wherein a material of the antenna layer comprises a conductive material having fluidity and ductility, wherein the material of the antenna layer comprises a liquid metal.

2. The golf ball of claim 1, wherein the antenna layer is provided on a surface of the at least a layer of ball shell or on a surface of the at least a layer of ball core.

3. The golf ball of claim 1, wherein the antenna layer is provided symmetrically to a ball center of the golf ball.

4. The golf ball of claim 1, comprising at least two chips, wherein the at least two chips are provided between the at least a layer of ball shell and the at least a layer of ball core or on the outer side of the at least a layer of ball shell and are electrically connected to the antenna layer.

5. The golf ball of claim 4, wherein the at least two chips are provided symmetrically to a ball center of the golf ball.

6. The golf ball of claim 4, wherein the at least two chips are provided on a surface of the at least a layer of ball shell or on a surface of the at least a layer of ball core.

7. The golf ball of claim 4, wherein the at least a layer of ball shell comprises a plurality of layers, and the at least two chips are provided between adjacent two layers of the ball shell.

8. The golf ball of claim 4, wherein the at least a layer of ball core comprises a plurality of layers, and the at least two chips are provided between adjacent two layers of the ball core.

9. The golf ball of claim 1, wherein the at least a layer of ball shell comprises a plurality of layers, and the antenna layer is provided between adjacent two layers of the ball shell.

10. The golf ball of claim 1, wherein the at least a layer of ball core comprises a plurality of layers, and the antenna layer is provided between adjacent two layers of the ball core.

* * * * *